US005855389A

United States Patent [19]

Andrus et al.

[11] Patent Number: 5,855,389

[45] Date of Patent: Jan. 5, 1999

[54] TORSIONALLY REINFORCED SNOWBOARD

[75] Inventors: Cameron W. Andrus, Vashon; Luke J. Edgar, Seattle; Patrick M. Timmons, Port Orchard, all of Wash.

[73] Assignee: K-2 Corporation, Vashon, Wash.

[21] Appl. No.: 778,803

[22] Filed: Jan. 3, 1997

Related U.S. Application Data

[63] Continuation-in-part of Ser. No. 594,286, Jan. 30, 1996.

[51] Int. Cl.[6] ..... A63C 5/03

[52] U.S. Cl. ..... 280/602; 280/610; 280/14.2

[58] Field of Search ..... 280/601, 602, 280/610, 609, 14.2

[56] References Cited

U.S. PATENT DOCUMENTS

| | | | |
|---|---|---|---|
| 2,384,729 | 9/1945 | Darby . | |
| 2,395,650 | 2/1946 | Allen . | |
| 2,526,137 | 10/1950 | Hunt . | |
| 2,795,431 | 6/1957 | Metcalfe et al. | 280/602 |
| 3,300,226 | 1/1967 | Reed, Jr. | 280/602 |
| 3,722,901 | 3/1973 | Koike . | |
| 3,917,299 | 11/1975 | Anderson . | |
| 4,349,212 | 9/1982 | Svoboda . | |
| 5,016,901 | 5/1991 | Mayr . | |
| 5,096,217 | 3/1992 | Hunter . | |
| 5,197,752 | 3/1993 | Engelbert et al. . | |
| 5,221,105 | 6/1993 | Mayr et al. . | |
| 5,320,378 | 6/1994 | Wiig . | |
| 5,401,041 | 3/1995 | Jespersen . | |
| 5,419,665 | 5/1995 | Adams et al. . | |
| 5,447,322 | 9/1995 | Masson et al. . | |
| 5,448,016 | 9/1995 | Jodelet . | |
| 5,492,357 | 2/1996 | Fagot | 280/602 |
| 5,514,018 | 5/1996 | Hara . | |
| 5,573,264 | 11/1996 | Deville et al. . | |
| 5,609,351 | 3/1997 | Vermillion . | |

FOREIGN PATENT DOCUMENTS

| | | |
|---|---|---|
| 0 553 417 A1 | 8/1993 | European Pat. Off. . |
| 0 622 096 A1 | 11/1994 | European Pat. Off. . |
| 1.282.053 | 12/1961 | France . |
| 2 692 158 | 12/1993 | France . |
| 0.620.028 A1 | 4/1994 | France . |
| 2 696 354 | 4/1994 | France . |
| 2 703 257 | 10/1994 | France . |
| 2 729 086 | 7/1996 | France . |
| 2 731 159 | 9/1996 | France . |
| 1 923 367 | 11/1970 | Germany . |
| 29 13 250 | 10/1980 | Germany . |

*Primary Examiner*—J. J. Swann
*Assistant Examiner*—Michael Mar
*Attorney, Agent, or Firm*—Darren J. Jones

[57] ABSTRACT

A snowboard having a forward end with a shovel and rearward end with a heel. The forward shovel and rearward heel include forward and rearward contact areas on both the right and left sides. The snowboard includes a base sheet, a core, a top sheet, forward and rearward binding fastening regions, and a first reinforcement member. The core is disposed above the base sheet. The top sheet is disposed above the core. The forward and rearward binding fastening regions are disposed between the shovel and heel. The first reinforcement member is disposed between the core and the top sheet and extends from adjacent one of the forward and rearward binding fastening regions to adjacent both contact areas on one end of the snowboard. The first reinforcement member includes a right leaf spring member and a left leaf spring member. The right leaf spring member extends generally from the binding fastening region toward the right contact area. The left leaf spring member extends generally from the binding fastening region toward the left contact area. The right and left leaf spring members are, with respect to the core and top sheet, substantially affixed at one end. At the opposite end, the spring members are moveably secured between the top sheet and core.

17 Claims, 4 Drawing Sheets

TORSIONALLY REINFORCED SNOWBOARD

This application is a continuation in part of Ser. No. 08/594,286 filed Jan. 30, 1996.

FIELD OF THE INVENTION

This invention relates to snowboards and methods of constructing snowboards and, more particularly, to a torsionally reinforced snowboard.

BACKGROUND OF THE INVENTION

Most snowboards have several features in common, such as a longitudinal center axis, at least one tip, sidecut on both sides, and binding mounts for both feet. However, as with skis, manufacturers construct different types of snowboards for different snowboarding activities. Freestyle boards tend to be short and have upturned tips and tails. Cruising boards for carving on groomed runs tend to be long and stiff and include some damping to maintain edge hold. Backcountry powder boards are wide and long and may have binding fasteners (i.e., inserts) shifted rearwardly. All-around boards for both freestyle and freeriding fall somewhere in between these features.

Jumping is one activity particularly popular with freestyle riders. Launching into the air may be accomplished on a mound of snow, from the edge or side of a snowboard half-pipe, off a ledge, drop-off, other structures, or anywhere else imaginable. In order to use the board to jump higher, experienced riders will often load the shovel or heel of the board just prior to take off. This maneuver helps to spring the rider further up, similar to diving off a diving board (except that the board is attached to the jumper's feet). Snowboards may be stiffly constructed to provide more launch power. However, freestyle boards are typically short and a stiff, short board will not ride with quiet control and speed on hardpack surfaces. Furthermore, snowboarders typically hit jumps at an angle (not straight-on). The rider must hold an edge bite in the last and most critical ten feet of the approach, especially when loading the tip or tail. Therefore, torsional rigidity and control from the bindings to the edge contact points may be even more important. Landing from a jump also is also preferably controlled, smooth, and soft.

The snowboard of the present invention was developed to provide additional torsional strength between the bindings and the snowboard edge contact points for improved jumping. The board maintains good midflex and carving ability, as well as superior damping even with short board lengths. Increased edge stability and control and smoother, more cushioned landings from jumps also result from the present snowboard construction. Thus, a snowboard is provided that improves performance in freestyle jumps and stunts while maintaining excellent freeriding characteristics.

SUMMARY OF THE INVENTION

The present invention provides significant advantages over prior art snowboard constructions and methods of construction with a snowboard that includes a rearward end, a forward end, and forward and rearward binding fastening regions. The rearward end has a heel with right and left heel contact areas. The forward end has a shovel with right and left shovel contact areas. The snowboard includes a base sheet, a top sheet, and a first reinforcement element. The top sheet is above the base sheet. The first reinforcement element is disposed between the base sheet and the top sheet and extends from adjacent at least one of the binding fastening regions to adjacent one of the contact areas. This provides for physical energy transmission between the contact area and the binding fastening region.

In the preferred embodiment of the invention, the snowboard also includes a second reinforcement element disposed between the base sheet and the top sheet. The second reinforcement element extends from adjacent the same binding fastening region as the first reinforcement element to adjacent the other contact areas at the same end of the snowboard as the first reinforcement element. Preferably, the first and second reinforcement elements are stripped of material. The strips cross each other adjacent the binding fastening region. The strips are preferably constructed with carbon composite material.

In another aspect of the invention, the snowboard includes a core disposed between the base and top sheets. In one preferred embodiment, the strips are disposed between the base sheet and the core. Preferably, a foam member is disposed between the core and the top sheet. The foam member extends from adjacent one of the binding fastening regions to adjacent one of the contact areas.

In one preferred aspect of the invention, the snowboard also includes a first upper reinforcement element disposed between the core and the top sheet. The first upper reinforcement element extends generally along a path from one of the binding fastening regions to one of the contact areas. The first upper reinforcement element is preferably a strip of spring material. One of the end of the strip is affixed beneath the top sheet with the opposite end held beneath the top sheet and moveable with respect thereto upon flexure of the snowboard. To enable the movement of the stripped end, it is coated with a plastic sheath that allows the strip to elastically shear the plastic from movement within the snowboard. In the preferred embodiment, the spring strip comprises titanal and the sheath comprises urethane.

The snowboard, in another preferred aspect, includes a second upper reinforcement element. The second reinforcement element is a second spring strip having one end affixed beneath the top sheet. The opposite end is held beneath the top sheet and is moveable with respect thereto upon flexure of the snowboard. The second upper element extends generally along a path from the same binding fastening region as the first upper element, but extends to the opposite contact area.

This preferred embodiment further includes a sheet of foam material extending over the first and second upper reinforcement elements from the binding fastening region to the right and left contact areas of the snowboard. The foam is impregnated with resin and forms an upper surface contour with the top sheet. In one aspect of the invention, the snowboard includes a core disposed between the base and top sheets. The strips are disposed between the top sheet and the core in a preferred embodiment thereof.

In another preferred aspect of the invention, the snowboard includes a composite structural layer between the core and top sheet. The foam member is disposed between the composite structural layer and core. The top sheet forms a raised area on top of the snowboard that extends from the binding fastening region to the contact area with foam beneath the composite structural layer and top sheet and above the strips.

Preferably, the foam member includes two legs. One of the legs extends from the binding fastening region to one of the right contact areas. The other leg extends to the left contact area at the same end of the snowboard. The legs are connected near the binding fastening region.

The preferred embodiment of the invention may also be described as a snowboard including a forward end, a rearward end, and forward and rearward binding fastening regions. The rearward end has a heel with right and left heel contact areas. The forward end has a shovel with right and left shovel contact areas. The snowboard includes a top sheet, a base sheet, and a first member. The base sheet is below the top sheet. The first member is disposed between the top sheet and the base sheet. The first member has a first end substantially fixed relative to the top sheet and a second end moveable relative to the top sheet.

In the preferred embodiment, the second end of the first member is coated with a sheath and is moveable within the sheath. The sheath comprises a plastic material, a portion of which elastically deforms upon movement of the second end. Preferably, the first member comprises titanal.

In another aspect, the snowboard includes a core between the top sheet and the base sheet. The first member is disposed between the top sheet and the core. The snowboard also includes a foam member disposed between the first member and the top sheet. The foam member forms a raised area on top of the snowboard, extending from at least one of the binding fastening regions to at least one of the contact areas. The snowboard construction of the present invention provides several advantages over prior snowboards. One particular advantage of the design is to enable a snowboard rider to jump higher and with more control, whether jumping within a snowboard half-pipe, quarter-pipe, or any other kind of jump or from any other launch site. The design enables the rider to hit the take-off with more control and accuracy, maneuver the board with greater ease and more control in the air, and hit the landing with more consistency and cushion. Each of the strips combined within the respective right and left legs on both the front and rear of the board forms a structural fork in the board. Each fork extends from the binding fastener so that forces are transmitted from the snowboard boot through the binding and into the forked reinforcement element. The fork transmits forces from the bindings onto the edge of the snowboard. Thus, the torsional strength of the board from the binding to the general area of the contact points of the board is increased. The contact points of the board are located at the shovel and heel where the board first touches the snow when laid on edge. Thus, the reinforcement elements help transmit the energy from the rider's feet in the binding areas diagonally out to the edges. Since snowboarders typically hit jumps at an angle (not straight on), the torsional reinforcement elements help to hold the edge bite in the last and most critical portion of the approach when the rider can "snap" off the tail by loading up the fork like a diving board. This causes the rider to spring higher into the air. The torsional reinforcement elements also add damping to the tip and tail areas of the board which results in a smoother, more stable ride. Riders who normally use a longer board have been able to use a shorter board for easier jumps and stunts and still have as much or more control at high speeds. The reinforcement elements preferably do not extend over the mid-section of the snowboard between the binding fastening zones. Thus, the board flexes well in this central region, such that the board remains soft enough to provide excellent carving and soft jump landings.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
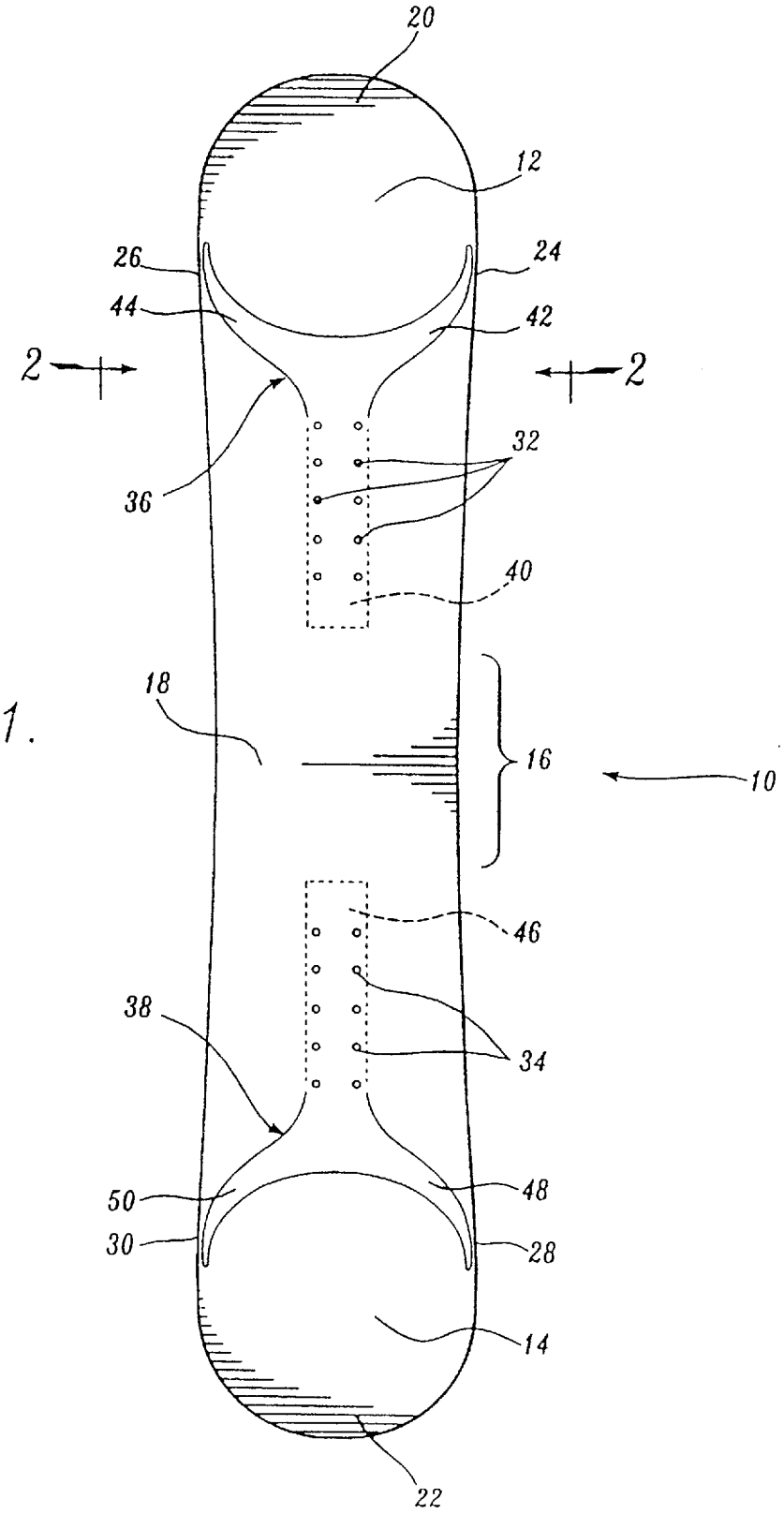
FIG. 1 is a plan view of a snowboard, incorporating the forks of the present invention with the portions of the forks that project upwardly from the top of the board shown in solid lines and those that are integrated flat with the top of the board shown in phantom lines.

Referring to FIG. 1, a snowboard 10 is provided that includes a shovel 12 at the front of the board, a heel 14 at the rearward end of the board, and a midportion 16 between the two. A waist 18 is located at the narrowest portion of the board generally in the middle of midportion 16. A tip 20 extends upwardly at the front of the board at the forward end of shovel 12. A tail 22 extends upwardly at the rearward end of heel 14.

The locations on the sides of snowboard 10 with the greatest width are on the right and left sides of shovel 12 and heel 14 and are termed the contact points. A right shovel contact point 24 is on the right side of shovel 12 and a left shovel contact point 26 is on the left side of shovel 12. Likewise, a right heel contact point 28 and left heel contact point 30 are situated at the edges of heel 14. These contact points are the first points to contact the snow surface when snowboard 10 is put on edge due to the side camber of snowboard 10.

Forward inserts 32 and rearward inserts 34 are also disposed within the body of snowboard 10 for use in securing snowboard bindings thereto. Forward inserts 32 preferably include between eight and twelve inserts. Inserts 32 and 34 are placed within the core of the snowboard and project up toward the top surface with an opening in the top surface and a threaded bore in the inserts for attachment of screw fasteners thereto from the bindings. Two columns of five inserts each are shown in the preferred embodiment of FIG. 1. However, other configurations may alternatively be used. The rearwardmost of forward inserts 32 is forward of midportion 16 of snowboard 10. The forwardmost of rearward inserts 34 is rearward of midportion 16. Forward and rearward inserts 32 and 34 are positioned for optimum placement and adjustability of snowboard bindings, which are to be secured thereto.

The improvement of the basic configuration of snowboard 10 will now be discussed. As seen in FIG. 1, two forks, a forward fork 36 and a rearward fork 38, are provided within snowboard 10. As explained in more detail below, each of these forks transmits torsional forces from the bindings mounted to inserts 32 and 34 to the edges of snowboard 10 adjacent the contact points. Thus, in the region between the forward snowboard binding (the region of inserts 32) and shovel contact points 24 and 26, the torsional rigidity of snowboard 10 is increased such that the energy of the user is efficiently transmitted over this distance to the edge. Likewise, between the rearward binding and heel contact points 28 and 30 the torsional stiffness is increased.

However, the board remains flexible for proper carving and control, since the remainder of the board does not include the extra reinforcement material. For example, in the preferred embodiment, midportion 16 does not include any portion of forks 36 and 38.

Forward fork 36 is constructed of a forward strip 40 extending around forward inserts 32. Forward strip 40 begins adjacent the rearwardmost of forward inserts 32. Forward strip 40 extends forwardly with a width slightly greater than the columns of forward inserts 32. Forward strip 40 extends toward tip 20 along the longitudinal axis of snowboard 10 to a position forward of forward inserts 32. At that point, forward fork 36 splits into right and left directions to form a right forward leg 42 and left forward leg 44. In the preferred embodiment, legs 42 and 44 extend transversely to the longitudinal axis of snowboard 10 as they begin to diverge from forward strip 40. As legs 42 and 44 extend outwardly, they curve forwardly such that they extend adjacent right and left shovel contact points 24 and 26. As legs 42 and 44 extend outwardly and forwardly, they also taper in width until, at the contact points, they are less than one-fourth as wide as forward strip 40.

Rearward fork 38 is constructed in the same manner as forward fork 36 with a rearward strip 46 extending along and surrounding rearward inserts 34, a right rearward leg 48, and left rearward leg 50. Thus, rearward fork 38 is substantially a mirror image of forward fork 36. Right and left rearward legs 48 and 50 extend from the rearward end of rearward strip 46 to right and left heel contact points 28 and 30.

Note that other overall configurations could be used to accomplish the same transfer of forces from the binding fastening zone to the edges of the snowboard. For example, a T-shape or a triangular shape could be used instead of a fork shape. The basic construction of a reinforcement element around the binding area and extending toward the edges of the snowboard, preferably toward the contact points, is encompassed by the present invention.

Figure 2:
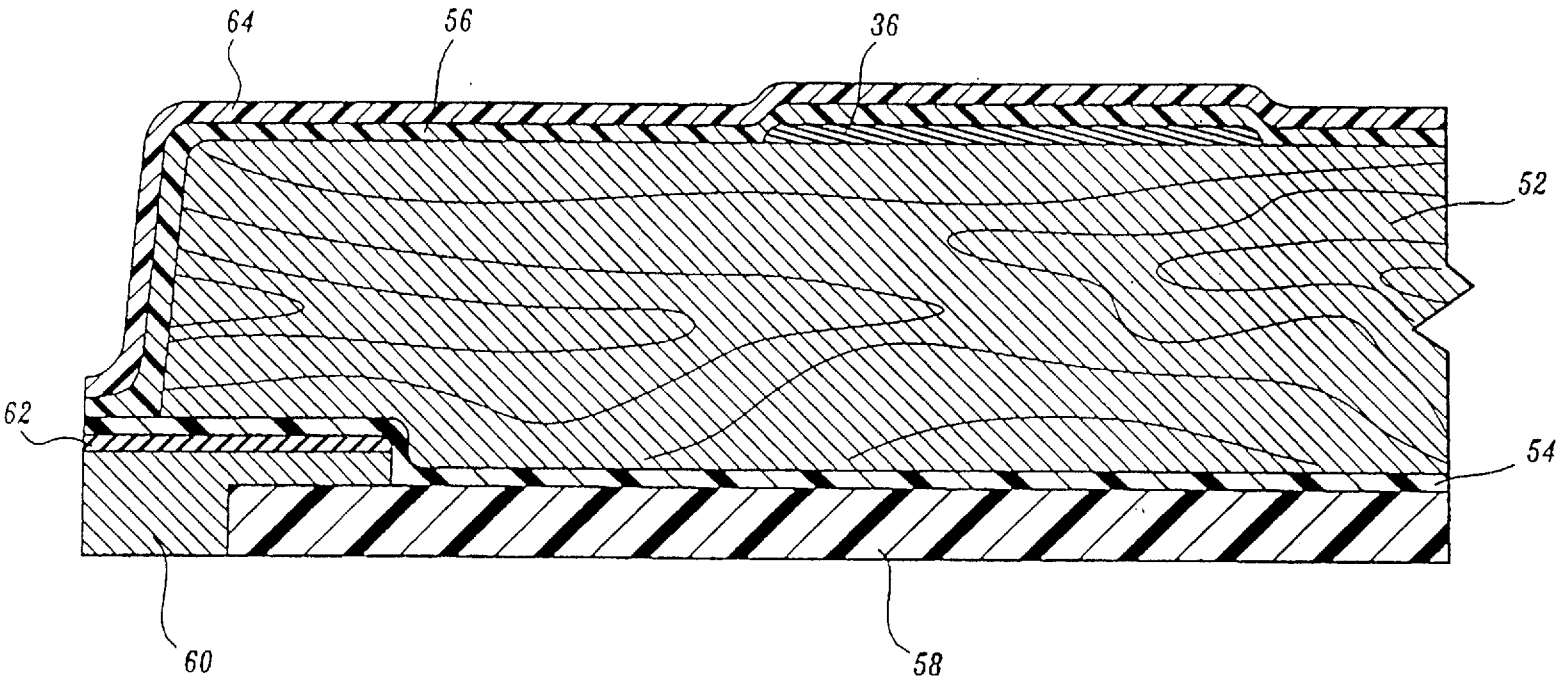
FIG. 2 is a cross-sectional view showing the preferred positioning of the fork within the body of the snowboard.

The preferred internal construction of forks 36 and 38 of snowboard 10 are illustrated in FIG. 2. Snowboard 10 includes a core 52 preferably constructed of vertically-laminated wood. A base structural layer 54 underlies core 52 and provides structural rigidity to snowboard 10, as well as structural support for the bottom of snowboard 10. A top structural layer 56 surrounds the top and, preferably, the sides of core 52. Top structural layer 56 and base structural layer 54 are preferably made in a conventional fashion with thermoset, resin-impregnated fiberglass material.

A base 58 is secured beneath base structural layer 54 and provides the riding surface of snowboard 10. Base 58 is preferably constructed of polyethylene, either sintered or extruded. Edges 60 are provided on the lateral sides of snowboard 10 adjacent base 58 and are secured thereto with base structural layer 54 in a conventional manner. Edges 60 may also include rubber layer 62 to provide damping and some shock absorption to edges 60. Rubber layer 62 directly overlies edge 60. A top layer 64 extends over the top and sides of core 52 and top structural layer 56 to protect top structural layer 56 and to provide snowboard graphics. Top layer 64 is preferably constructed of a polyurethane material.

Forward and rearward forks 36 and 38 are preferably positioned on top of core 52 beneath top structural layer 56. FIG. 2 illustrates forward fork 36. Alternatively, forward fork 36 (or rearward fork 38) could be placed between top layer 64 and top structural layer 56. In the area adjacent forward and rearward inserts 32 and 34, forward and rearward strips 46 and 48 are flattened out with top structural layer 56 such that they do not cause an upward projection of top layer 64 on snowboard 10. This flattened area facilitates fastening any snowboard bindings onto inserts 32 and 34 adjacent a flat top surface of snowboard 10. In other words, the fiber layers of structural layer 56 and forks 36 and 38 are compressed together in the molding tool such that the cured shape is flat in this region. In contrast, the molding tool allows legs 42, 44, 48, and 50 to project upwardly and forward of forward strip 40 and rearward of rearward strip 46 such that the top of snowboard 10 bulges slightly upwardly in the region of legs 42, 44, 48, and 50. This bulging is illustrated in FIG. 2.

Forks 36 and 38 are preferably constructed of a carbon and glass fiber composite material impregnated with a thermosetting resin. However, alternate constructions with different materials, such as metals or other composites, could be used. Also, the positioning of fork 36 could be altered. For example, fork 36 may be placed on top of top layer 64, between top layer 64 and top structural layer 56, within core 52, or even between core 52 and base structural layer 54. The principle focus of the fork (or other torsion shape) is to transmit the torsional forces from the binding attachment at the inserts to the edge of the snowboard, preferably to the contact point, since this is the location at which much of the contact force is provided when jumping. Alternatively, forward fork 36 and rearward fork 38 could be interconnected throughout mid-portion 16, possibly with a reduced material cross section. However, in the preferred embodiment, mid-portion 16 does not include coverage by either forks 36 or 38. This allows snowboard 10 to maintain an adequate flex pattern and proper curvature for carving turns. Also, note that the width of forward strip 40 and rearward strip 46 is not excessive, so that extreme longitudinal stiffness is not created.

Another preferred embodiment of the present invention will now be described in connection with FIGS. 3–5. Throughout the following description, the last two digits of reference numerals refer to elements similar in construction to those described above and illustrated in FIGS. 1 and 2. A "1" is placed in front of the previous numerals to indicate the embodiment of FIGS. 3–5.

Figure 3A:
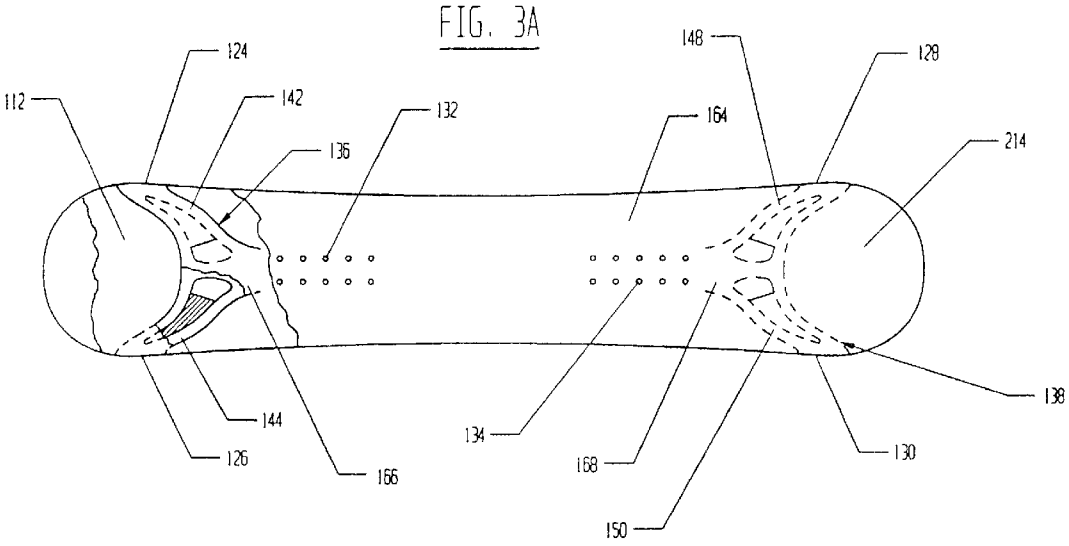
FIG. 3A is a top view of a preferred embodiment of the snowboard with a cut-away portion.

Referring first to FIG. 3A, snowboard 110 includes forward and rearward torsion forks 136 and 138. In this embodiment, torsion forks 136 and 138 extend from adjacent forward and rearward inserts 132 and 134 respectively. Forward torsion fork 136 extends forwardly of forward inserts 132 and outwardly toward right and left shovel contact areas 124 and 126. Likewise, rearward torsion fork 138 extends rearwardly and outwardly from rearward inserts 134 toward right and left heel contact points 128 and 130 respectively. The general shape of torsion forks 136 and 138 is that of a "Y," but in this embodiment the cross section is somewhat wider than that of the embodiment illustrated in FIG. 1. Also, the ends of the right and left fork legs 142, 144, 148, 150 are wider than that of FIG. 1 and flare out to the contact points 124–130.

Torsion forks 136 and 138, in this embodiment, are constructed with resin-impregnated, reticulated foam members cut into a forked Y-shape. The foam is cut into the proper shape and then, during lay-up of the snowboard, the wet resin seeps into the open-cell foam structure of the reticulated foam. Alternatively, other materials such as fiberglass, carbon, metal, or other structure could be used. However, with the lightweight foam material and the resin providing structure and changing the contour of the upper surface of the snowboard, torsional strength increases and enables the transmission of forces from contact points 124–130 to the binding fastening areas, inserts 132 and 134. Note in FIG. 5 that forward and rearward foam members 166 and 168 are disposed between the snowboard core 152 and top structural layer 156, as well as top sheet 164 form a contoured convex top projection on snowboard 110. Such a contour alone provides structural support to snowboard 110, especially in the direction of the upward projection or raised area.

In the preferred embodiment, foam members 166 and 168 are constructed with a reticulated rubber-like synthetic foam. The resin from the lay-up snowboard somewhat impregnates the foam and then cures after the snowboard is molded. Foam members 166 and 168 make up the basic shape of forward and rearward torsion forks 136 and 138.

Figure 3B:
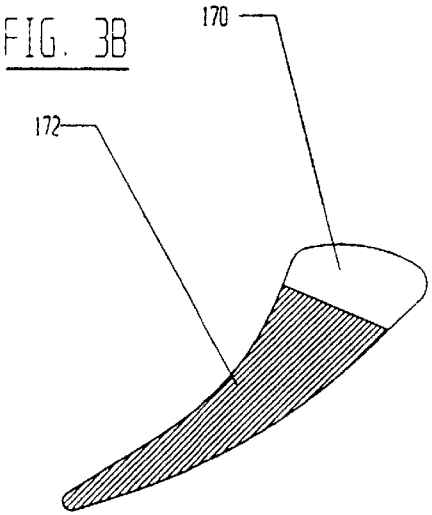
FIG. 3B is an enlarged view of the spring element from FIG. 3A.

Torsion forks 136 and 138 also include a spring 170 with a sheath 172 covering a portion thereof. As seen in FIGS. 3A and 3B, spring 170 has a elongated, bent triangular configuration with rounded corners. The small end of the triangle extends toward the respective contact point of the snowboard. The wide end of spring 170 is positioned adjacent the center of torsion fork 136 or 138 near the inserts. Spring 170 is positioned within a leg of the torsion fork. As seen in FIG. 5, spring 170 is positioned between core 152 and foam member 166 or 168. Springs 170 are preferably constructed with titanal, a 7000 series aluminum alloy. Alternatively, other metals or composite materials could be used.

The forward ends of springs 170 within forward torsion fork 136 and the rearward ends of springs 170 within rearward torsion fork 138 are coated with sheaths 172. Sheaths 172 are preferably constructed of a urethane, plastic material. Springs 170 are coated with sheaths 172 by dipping springs 170 into urethane and allowing it to cure. The purpose of coating a portion of springs 170 with sheaths 172 is to allow the end of springs 170 to move within snowboard 110 upon flexure of snowboard 110. The uncoated ends of springs 170 are bonded between core 152 and foam member 166 or 168. Thus, this end is affixed and does not substantially move in relation to snowboard 110 when the board is flexed. However, sheath 172 allows spring 170 to shift slightly within sheath 172 by elastically shearing within the urethane of sheath 172. Thus, sheath 172 can be bonded between the foam member and core 152, while still allowing movement of spring 170 at its end and thus, improve the rebound characteristics of spring 170. Urethane sheath 172 also functions to dampen the snowboard between the contact points and the inserts and results in a quiet ride and the elimination of unwanted vibrations.

Alternate embodiments of springs 170 with sheaths 172 may include attached inward ends of springs 170 in both or either the forward torsion fork and rearward torsion fork. Furthermore, such integrated springs, extending from right to left contact areas, may extend and surround some or all of inserts 132 and 134. The right and left springs could be integrated into a single spring extending in a Y shape. Thus, the inward ends of springs 170 would thus be bound from movement relative to snowboard 110 while the extremities would move within sheaths 172. Furthermore, alternate sheath material could be used on springs 170 to provide various damping and movement characteristics.

Figure 4:
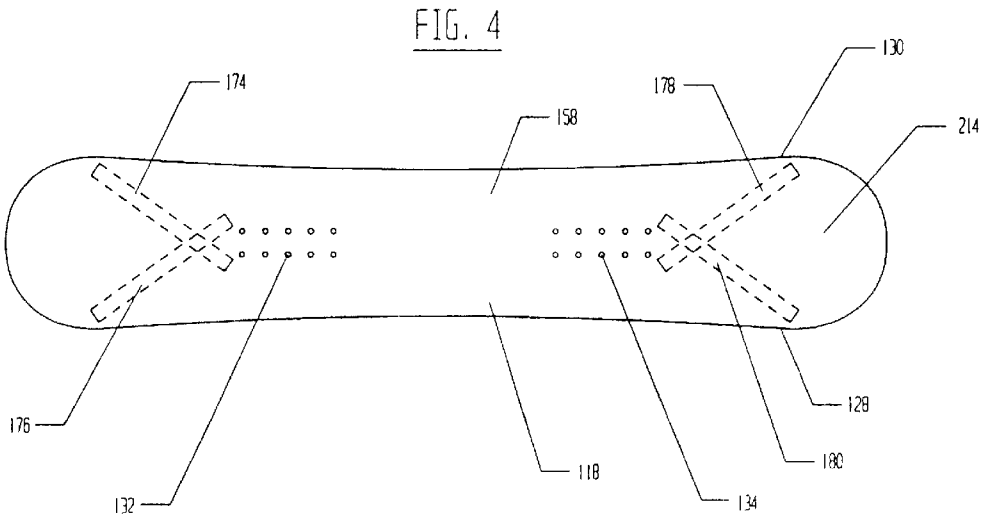
FIG. 4 is a bottom view of the embodiment of FIG. 3A showing torsion reinforcement strips.
Figure 5:
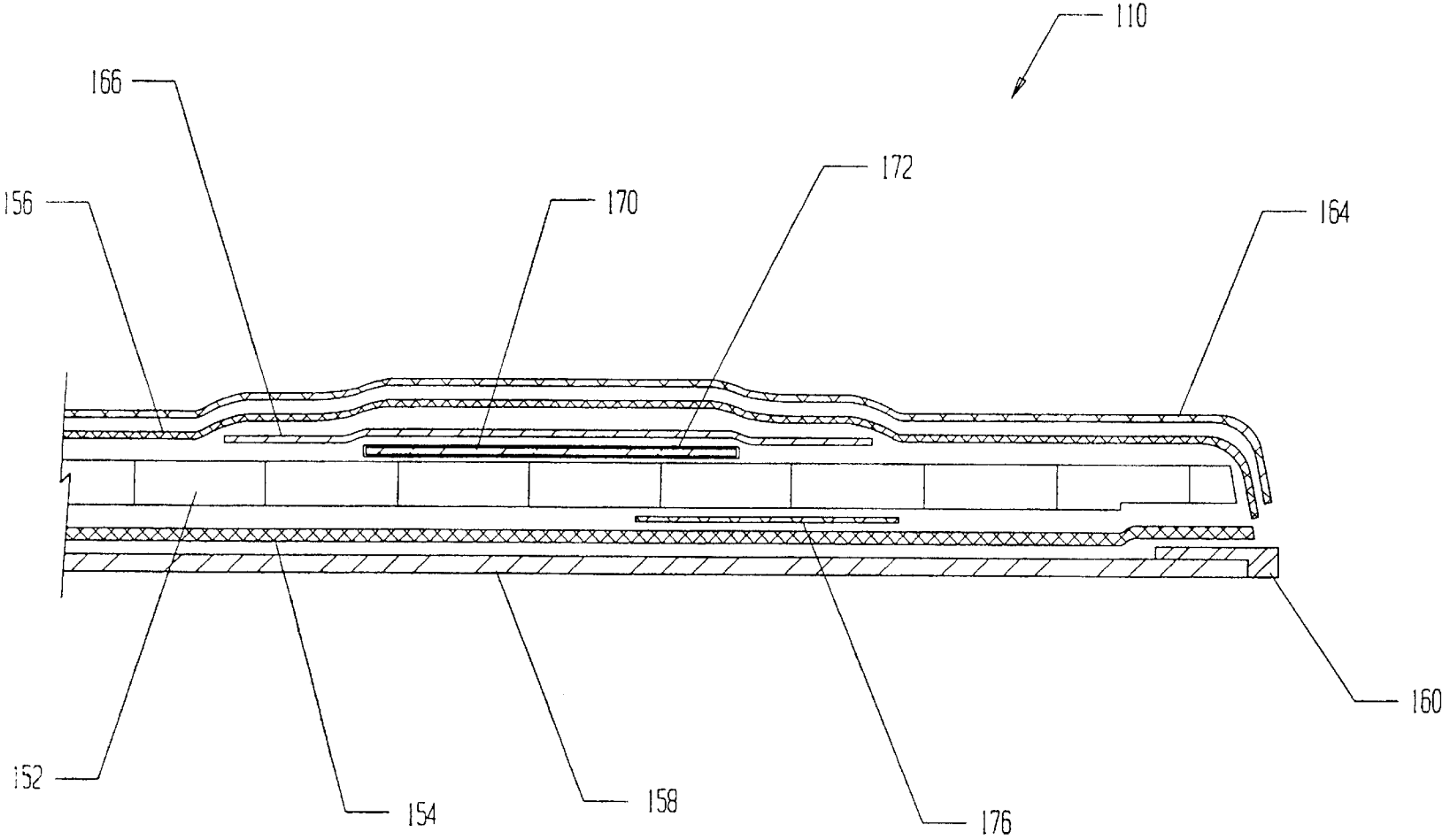
FIG. 5 is a cross-sectional, exploded view of the snowboard illustrated in FIG. 3 and FIG. 4.

Referring now to FIG. 4, additional torsional reinforcement to snowboard 110 is provided by strips 174, 176, 178, 180. While the strips in alternate embodiments are located above and below core 152 and between any of the layers on either side of core 152, preferably strips 174, 176, 178, 180 are located between base structural layer 154 and core 152 (see FIG. 5). As seen in FIG. 4, the strips extend from adjacent the four contact areas of the snowboard to adjacent the binding fastening regions, snowboard inserts 132 and 134. The four strips are preferably individually formed with carbon composite material and placed on the base structural layer 154 when assembling the snowboard before pressing. The ends of the four strips closest to the binding fastening regions cross over the center line of the board and cross over the other strip at the same end of the board that extends to the opposite contact area. Thus, in this form, strips 174, 176, 178, 180 are easy to manufacture and place within a snowboard and are very effective at transferring torsional forces from the binding fastening regions to the contact areas on the outer sides of the fore and aft portions of the snowboard. The material composition and shape and size of the strips may be varied to alter the torsional and flex characteristics of the snowboard. As discussed above, other configurations of these strips, which essentially form torsion forks in the forward and rearward portions of the board, can be used.

Various alternate embodiments of the present invention may be employed. For example, springs 170 within sheaths 172 would not have to be used as a torsion stiffener as shown on snowboard 110. For example, springs 170 beneath a top sheet, and possibly also beneath a top structural layer, could be used within a body of a ski in order to change the rebound, flex, and damping characteristics of the ski. In this situation, the spring may have a longitudinal axis collinear with the longitudinal axis of the ski.

While the preferred embodiments of the invention have been illustrated and described, it will be appreciated that various changes can be made therein without departing from the spirit and scope of the invention.

The embodiment of the invention in which an exclusive property or privilege is claimed is defined as follows:

1. A snowboard including a forward end, a rearward end, and forward and rearward binding fastening regions, the rearward end having a heel including right and left heel contact areas, the forward end having a shovel including right and left shovel contact areas, the snowboard comprising:

(a) a top sheet;

(b) a reinforcement member disposed below said top sheet;

(c) a core disposed below said top sheet;

(d) a base sheet disposed below said reinforcement member and said core; and (e) a first spring member disposed between said top sheet and said base sheet, said first spring member having a first end portion, a second end portion and an elastic covering, disposed within a cavity, that at least partially covers the second end portion of said first spring member while leaving a section of the first end portion uncovered, the uncovered section of the first end portion of said first spring member being fixedly connected to said core, wherein said second end portion is a free end portion such that said elastic covering permits movement of said second end portion within said cavity and relative to said core upon flexure of the snowboard.

2. The snowboard of claim 1, wherein said first spring member is disposed above said core.

3. The snowboard of claim 2, wherein said first spring member is disposed between said core and said reinforcement member.

4. The snowboard of claim 3, wherein the elastic covering comprises an elastic sheath substantially surrounding the second end portion of said spring member.

5. The snowboard of claim 1, wherein said first spring member is disposed between said core and said reinforcement member, the first end portion being fixedly joined to said core and said reinforcement member.

6. The snowboard of claim 5, wherein the elastic covering substantially surrounds the second end portion of said spring member.

7. The snowboard of claim 1, wherein said first spring member is directly mounted to said core.

8. The snowboard of claim 1, wherein said first spring member is configured as a strip.

9. The snowboard of claim 8, wherein the spring strip comprises a titanal strip.

10. The snowboard of claim 9, wherein the elastic covering comprises a urethane sheath applied to one end of the titanal strip.

11. The snowboard of claim 1, wherein said first spring member is disposed to extend generally along a path from one of the binding fastening regions to one of the contact areas.

12. The snowboard of claim 1, further comprising a second spring member having a first end portion and a second end portion, an elastic covering that at least partially covers the second end portion of said second spring member while leaving the first end portion at least partially exposed, the first end portion of the spring member being fixedly joined to said core, wherein said elastic covering portion permits movement of said second end portion within said elastic covering portion and relative to said core upon flexure of the snowboard, wherein said second spring member extends generally along the path from the same binding fastening region as said first spring member to an opposite contact area.

13. The snowboard of claim 12, wherein the reinforcement member comprises a sheet of foam material impregnated with resin that extends over said first and second spring members from the binding fastening region to the right and left contact areas of that end of the snowboard, the sheet of foam material forming an upper surface contour with the top sheet.

14. The snowboard of claim 1, wherein the reinforcement member is disposed to overlie the first spring member and form an upper surface contour with the top sheet.

15. The snowboard of claim 14, wherein the upper surface contour defines a raised area on the top of the snowboard extending from a binding fastening region to a contact area.

16. A snowboard including a forward end, a rearward end, and forward and rearward binding fastening regions, the rearward end having a heel including right and left heel contact areas, the forward end having a shovel including right and left shovel contact areas, the snowboard comprising:

(a) a top sheet;

(b) a reinforcement member disposed below said top sheet;

(c) a core disposed below said top sheet;

(d) a base sheet disposed below said reinforcement member and said core; and (e) a spring member disposed between said core and said reinforcement member, said spring member having a first end portion fixedly connected to said core and said reinforcement member, and a second end portion disposed within a cavity defined between said core and said reinforcement member, wherein the second end portion is a free end portion such that said second end portion can move within said cavity and relative to said core and said reinforcement member upon flexure of the snowboard.

17. The snowboard of claim 16, wherein the said cavity is filled with an elastic material.

* * * * *